US008453554B2

(12) United States Patent
Landies et al.

(10) Patent No.: US 8,453,554 B2
(45) **Date of Patent: *Jun. 4, 2013**

(54) M60 RIFLE WITH SELECT FIRE MECHANISM FOR SELECTIVE FULLY-AUTOMATIC SEMI-AUTOMATIC OPERATION

(75) Inventors: Robert I. Landies, Chardon, OH (US); Thomas M. Hardman, Chesterland, OH (US); Daniel L. Albright, Chardon, OH (US); Joshua G. Hershberger, Concord Township, OH (US)

(73) Assignee: Ohio Ordnance Works, Inc., Chardon, OH (US)

( * ) Notice: Subject to any disclaimer, the term of this patent is extended or adjusted under 35 U.S.C. 154(b) by 265 days.

This patent is subject to a terminal disclaimer.

(21) Appl. No.: 13/023,090

(22) Filed: Feb. 8, 2011

(65) Prior Publication Data

US 2012/0144993 A1 Jun. 14, 2012

Related U.S. Application Data

(60) Provisional application No. 61/302,336, filed on Feb. 8, 2010.

(51) Int. Cl.
*F41A 19/33* (2006.01)

(52) U.S. Cl.
USPC ..... 89/140; 89/132; 89/128

(58) Field of Classification Search
USPC ..... 89/128, 132, 139, 140, 141, 129.01
See application file for complete search history.

(56) References Cited

U.S. PATENT DOCUMENTS

| | | | | |
|---|---|---|---|---|
| 4,023,465 | A * | 5/1977 | Inskip | 89/131 |
| 4,448,109 | A * | 5/1984 | Johnson | 89/141 |
| 5,140,893 | A * | 8/1992 | Leiter | 89/14.5 |
| 5,623,114 | A * | 4/1997 | Soper | 89/141 |
| 5,760,328 | A * | 6/1998 | Robbins | 89/129.02 |
| 6,125,735 | A * | 10/2000 | Guhring | 89/141 |
| 7,600,338 | B2 * | 10/2009 | Geissele | 42/69.03 |
| 7,654,187 | B2 * | 2/2010 | Hochstrate et al. | 89/142 |
| 7,806,039 | B1 * | 10/2010 | Gomez | 89/132 |
| 7,895,933 | B2 * | 3/2011 | Quis | 89/139 |
| 7,950,178 | B1 * | 5/2011 | Landies et al. | 42/69.01 |
| 8,047,119 | B2 * | 11/2011 | Hochstrate et al. | 89/142 |
| 8,087,343 | B2 * | 1/2012 | Landies et al. | 89/140 |
| 2007/0051236 | A1 * | 3/2007 | Groves et al. | 89/142 |
| 2007/0266845 | A1 * | 11/2007 | Polston | 89/139 |
| 2011/0146484 | A1 * | 6/2011 | Landies et al. | 89/128 |
| 2011/0168008 | A1 * | 7/2011 | Landies et al. | 89/128 |
| 2012/0279384 | A1 * | 11/2012 | Hochstrate et al. | 89/142 |

* cited by examiner

*Primary Examiner* — Benjamin P Lee
(74) *Attorney, Agent, or Firm* — Renner Kenner Greive Bobak Taylor & Weber

(57) ABSTRACT

A trigger assembly for a trigger housing for a, M60 fully automatic rifle is provided having a switch accessible at the outside of the trigger housing for changing the firing of the rifle between semi-automatic and fully-automatic fire.

3 Claims, 5 Drawing Sheets

M60 RIFLE WITH SELECT FIRE MECHANISM FOR SELECTIVE FULLY-AUTOMATIC SEMI-AUTOMATIC OPERATION

CROSS-REFERENCE TO RELATED APPLICATION

This application claims the benefit of U.S. Provisional Patent Application No. 61/302,336, filed on Feb. 8, 2010, the contents of which are incorporated herein by reference.

FIELD OF THE INVENTION

This invention relates to an M60 machine gun including a select fire mechanism that permits the gun to be selectively operated to be either fully automatic or semi automatic.

BACKGROUND OF THE INVENTION

This invention provides a select fire mechanism for an M60 automatic rifle that permits the rifle to be operated to be either fully automatic or semi-automatic. The trigger assembly of this invention replaces what would be the typical trigger assembly of the M60, which effects fully automatic fire. The replacement of the standard M60 trigger assembly with the trigger assembly of this invention permits the rifle to be operated to be either fully automatic or semi-automatic according a selection made by the shooter.

In the M60 fully automatic rifle, the sear, which is part of the trigger assembly, holds back a spring-loaded operation rod assembly (herein "op rod assembly"), which is retained in the receiver, and pulling on the trigger pulls the sear out of engagement with the op rod assembly, thus permitting the op rod assembly to move under the influence of the spring acting upon the op rod assembly. Once released, the op rod moves forward and cycles internal striking mechanisms that cause a cartridge to be fired. Thereafter, expanding gases from the ignition of powder in the cartridge furnish the energy for the continued fully automatic operation or cycling of the rifle.

Immediately after firing, as the bullet traverses the barrel and passes an internal gas port prior to exiting from the muzzle, the live gases expand through appropriate ports to force the op rod assembly back against the bias of the spring that forces the op rod assembly toward the cartridge chamber. This loads the spring, and, once the pressure of the expanding gases dissipates, the spring again forces the op rod assembly forward to fire another round. So long as the trigger remains pulled, the sear remains out of the path of the op rod assembly, and the rifle continues to fire until the ammunition is exhausted. If the trigger is released, the sear moves back into the path of the op rod assembly, stopping the same and holding it in a spring-loaded position from which it can fire another round upon a subsequent squeezing of the trigger.

Because fully automatic fire is not always needed and not always desired, there is a need in the art for a rifle that includes a select fire mechanism permitting the rifle to be selectively operated as a fully automatic firearm or a semi automatic firearm.

SUMMARY OF THE INVENTION

The present invention generally provides a trigger assembly fitted to a trigger housing that is adapted to engage a receiver for an M60 Assault Rifle. As known for the M60 Assault Rifle, the receiver carries an op rod assembly that reciprocates within the receiver to fire the rifle. The trigger assembly of this invention includes a sear pivotally mounted to the trigger housing, the sear providing a sear tip and a latch end. A sear spring of the trigger assembly biases the sear to pivot to position the sear tip in the path of the op rod assembly when the trigger housing is engaged with the receiver and the trigger assembly is unactuated. The trigger assembly further includes a trigger pivotally mounted to the trigger housing, and a disconnector pivotally connected to the trigger. The disconnector provides a ramped surface and a catch end that is adapted to engage the latch end of the sear. The trigger assembly further includes a select fire mechanism including a switch that is accessible outside of the trigger housing and selectively movable between a fully automatic firing position and a semi automatic firing position, and a selector body is associated with the switch. The selector body includes a fully-automatic selector surface and a semi-automatic selector surface, and moving the switch between the fully automatic firing position and the semi-automatic firing position also moves the selector body between a fully automatic firing position and a semi-automatic firing position. A disconnector spring biases the disconnector toward the sear and the selector body, and actuating the trigger assembly draws the ramped surface of the disconnector against the selector body and, when the switch is in the fully-automatic firing position, the ramped surface is drawn against the fully-automatic selector surface and, when the lever is moved to the semi-automatic firing position, the ramped surface is drawn against the semi-automatic selector surface. When the ramped surface is drawn against the fully-automatic selector surface, the catch end of the disconnector engages the latch end of the sear and pulls thereon so as to pivot the sear tip out of the path of the op rod assembly and remain out of the path until the trigger is released, and, when the ramped surface is drawn against the semi-automatic selector surface, the catch end of the disconnector engages the latch end of the sear and pulls thereon so as to pivot the sear tip out of the path of the op rod assembly and thereafter disengages such that the sear pivots on the sear spring to again extend into the path of the op rod assembly after a single firing of the M60 Assault Rifle.

In a particular embodiment, the switch is a lever connected to the selector body, and the selector body is a longitudinal member having a longitudinal axis about which the longitudinal member rotates as the lever is moved. In this particular embodiment, the selector body includes a clearance cut defining a peripheral contact surface and a clearance cut surface. The peripheral contact surface serves as the semi-automatic selector surface in this embodiment, and the clearance cut surface serves as the fully-automatic selector surface.

DETAILED DESCRIPTION OF ILLUSTRATIVE EMBODIMENTS

Figure 1:
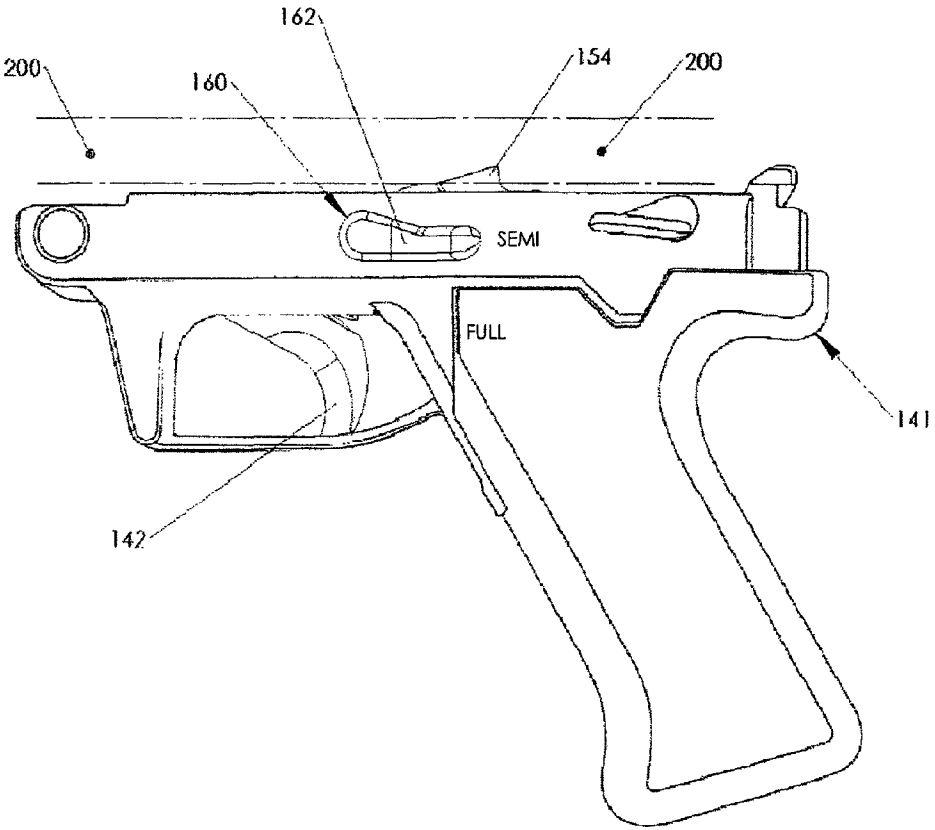
FIG. 1 is a side view of a select fire trigger assembly in accordance with this invention, showing the external grip portion and a lever that permits the selection of the type of firing.

This invention relates to the M60 Automatic Rifle, Caliber 7.62×51 mm, including known model variations. Particularly it relates to the conversion of an M60 to provide the same with a mechanism to selectively cause the rifle to fire in either a fully automatic or semi-automatic mode. This "conversion" may be in the form of replacing the trigger assembly of an M60 with a trigger assembly in accordance with this invention, or might be in the form of creating an M60 from scratch having select fire capabilities.

In the present invention, a select fire trigger assembly provides the desired select fire mechanism. Relevant portions of the select fire trigger assembly are shown in FIGS. 1-5. The select fire trigger assembly 140 is provided in a trigger housing 141 that connects to an M60 receiver to communicate with the M60 striking mechanisms. The trigger housing 141 connects to the receiver (known, not shown) so that the trigger assembly 140 can communicate with an op rod assembly (known, not shown) retained within the receiver. The trigger assembly 140 can be manipulated to allow or prevent the reciprocation of the op rod assembly and hence allow or prevent firing.

The select fire trigger assembly 140 includes a trigger 142 that is pivotally carried on a trigger pin 144. The crescent portion of the trigger 142 is below the pivot point established by the trigger pin 144, but the body of the trigger 142 extends above that pivot point to interact with a disconnector 146 pivotally secured to the trigger 142 by a disconnector pin 148. The disconnector 146 is biased by a disconnector spring 150 to engage a latch end 152 of a sear 154. The disconnector spring 150 is a compression spring acting between a mount 143 on the trigger 142 and a mount 147 on the disconnector 146 and applies force between the two such that the disconnector 146 is forced against the sear 154 and/or a selector body 164. It should be noted that, in FIGS. 2-5, the disconnector spring 150 is shown as being slightly off of the mount 147 merely as a result of the program employed to create the figures, and it should be appreciated that the mount 147 provides the area of receipt for the end of the disconnector spring 150 that is opposite the end secured at the mount 143 on the trigger 142. The pulling of the trigger 142 (rightward in the drawings) causes the disconnector 146 to be pulled forward and interact with the sear 154 and the selector body 164 as will be described more fully below.

The sear 154 is itself biased for limited rotational movement by a sear spring 156. The sear spring 156 is shown as a torsion spring, being wound about a sear spring pin 155 and having one end extending to act upon the sear 154 and another end extending to act upon a sear spring stop pin 157. Though a torsion spring is a preferred spring due to the force it can impart against the sear 154, other springs could be mounted in the trigger housing 141 to function in a similar manner. The sear 154 provides a sear tip 158 that, at rest (FIG. 1), extends above the top boundary of the trigger housing 141 so that, when the trigger housing 141 is connected to a receiver for an M60 Rifle, it can engage a sear ledge provided on the op rod assembly, as generally known.

The select fire trigger assembly 140 includes a select fire mechanism 160 that provides a lever 162 to be moved between a semi-automatic firing position (shown at the work "semi" in FIG. 1, though the "s" is covered by the lever 162) and a fully automatic firing position (shown in phantom in FIG. 1, where the lever 162 points to "full"). The lever 162 is accessible at the exterior of the trigger housing 141 so that it can be moved between these positions. As their names imply, when the lever 162 is moved to the semi-automatic firing position, the trigger assembly 140 will function to permit a single cycling of the op rod assembly, and hence semi-automatic firing, when the trigger 142 is squeezed, and, when the lever 162 is moved to the fully-automatic firing position, the trigger assembly 140 will function to permit continuous cycling of the op rod assembly, and hence fully-automatic firing, so long as the trigger 142 remains pulled.

With reference to FIGS. 2-5, the select fire mechanism 160 alters the functioning of the trigger assembly 140 by means of a selector body 164, which is connected to the lever 162 so as to rotate when the lever 162 is pivoted between the semi- and fully-automatic firing positions. The selector body 164 is positioned between the disconnector 146 and the sear 154, and serves as a stop for both the disconnector 146, as its ramped surface 166 is pushed against the selector body 164 by disconnector spring 150, and the sear 154, as its front end 168 is forced against the selector body 164, about sear pin 170, by the sear spring 156. The selector body 164 includes a clearance cut 172, which defines a peripheral contact surface 174 and an inset contact surface 176 (see FIG. 2A), and it is this clearance cut 172 that is repositioned by movement of the lever 162 to bring about the desire firing, semi or full automatic.

Figure 2:
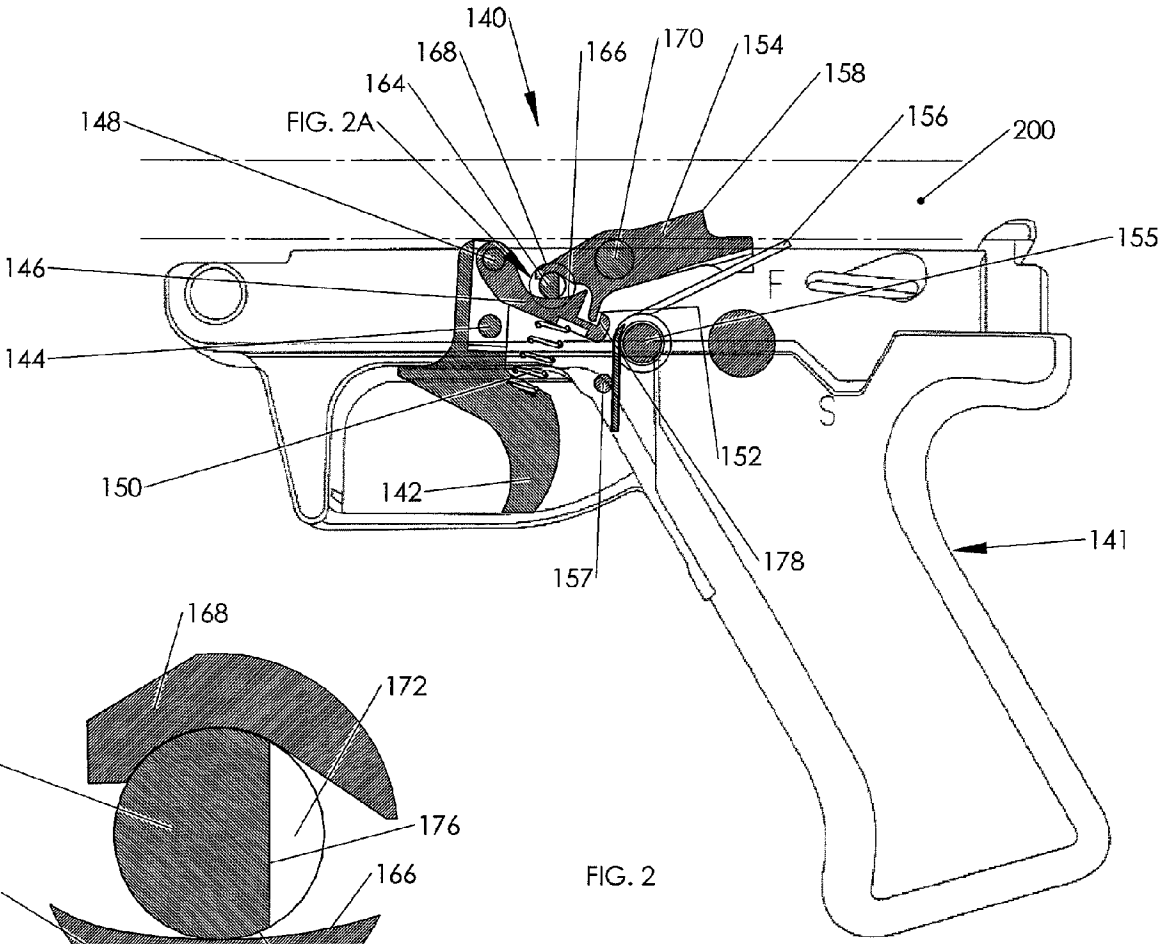
FIG. 2 is a side view, as in FIG. 1, showing the internal components of the select fire trigger assembly through the exterior of the trigger housing, the components being shown in semi-auto mode, with the trigger at rest.
Figure 2A:
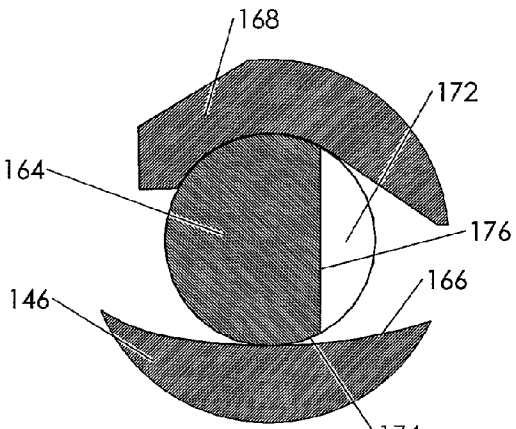
FIG. 2A is an enlarged view of the detail identified in FIG. 2 as Detail 2A.
Figure 3:
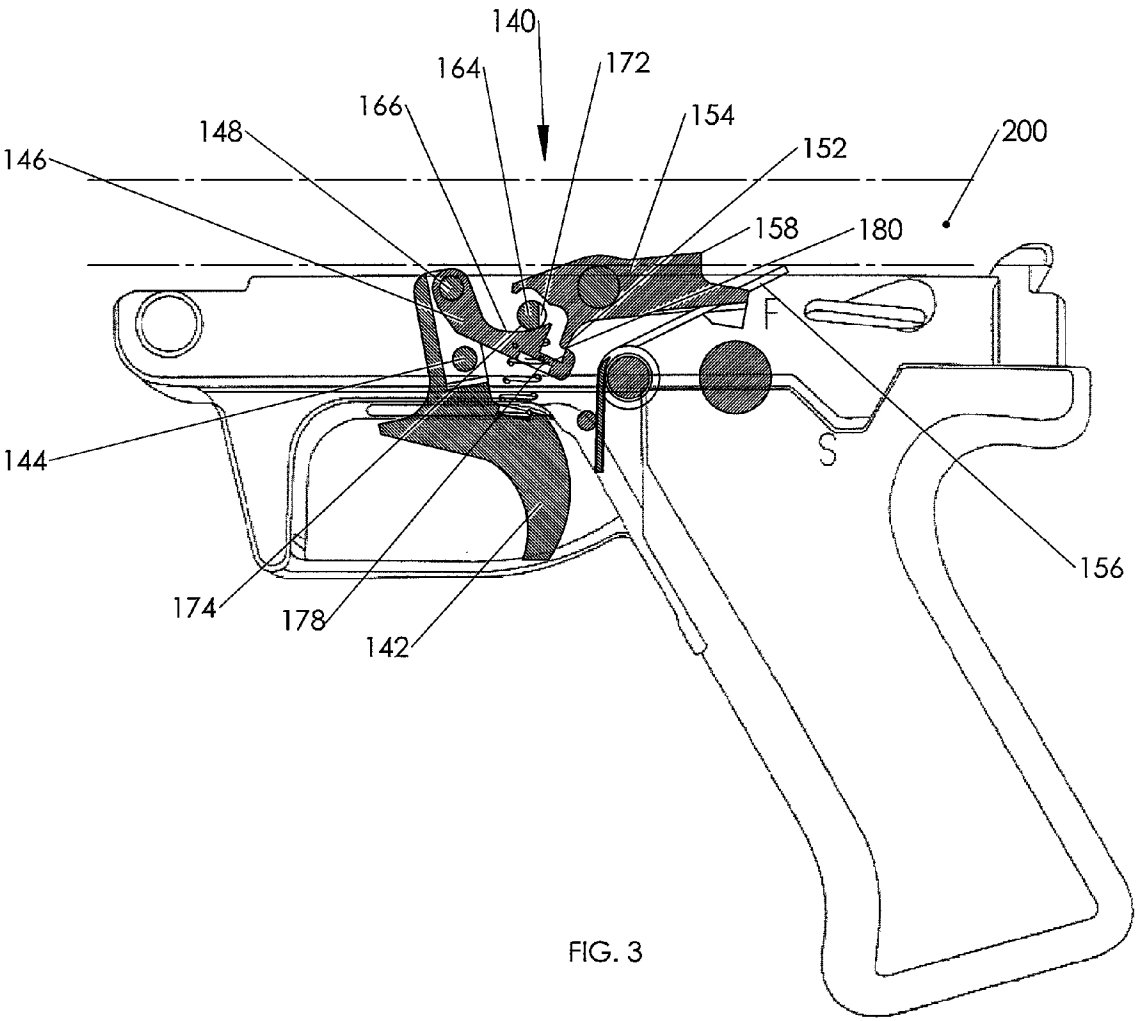
FIG. 3 is a side view, as in FIG. 2, the components being shown in semi-auto mode, with the trigger pulled to the position where the sear releases from the disconnector.

In FIGS. 2 and 3, the trigger assembly 140 is shown in the semi-automatic firing position. In FIG. 2, the trigger 142 is at rest, whereas, in FIG. 3, the trigger 142 has been pulled to the point where the sear tip 158 is outside of the path 200 of the sear ledge of the op rod assembly such that the sear tip 158 releases the op rod assembly for reciprocation. The select fire mechanism 160 is thus in the semi-automatic firing position. In this position, the ramped surface 166 of the disconnector 146 faces the selector body 164 with the selector body 164 positioned between the front end 168 of the sear 154 and the sloped surface. When the trigger 142 is pulled, as shown, the disconnector 146 is pulled forwardly at disconnector pin 148 pulling the ramped surface 166 of the disconnector 146 against the peripheral contact surface 174 of the selector body 164, thus forcing the disconnector 146 to also move downwardly against the disconnector spring 150. Notably, the clearance cut 172 is not engaged by the ramped surface 166, rather, the ramped surface 166 engages the peripheral contact surface 174, thus bringing about a larger downward movement than would be achieved if the ramped surface 166 engaged the inset contact surface 176. The forward and downward movement causes the catch end 178 of the disconnector 146 to pull on the latch end 152 of the sear 154, thus causing the sear 154 to pivot about the sear pin 170 until the sear tip 158 is made to disconnect from the sear ledge of the op rod, thus leading to the firing of a cartridge. The sear tip 158 pivots downwardly, out of the path 200 of the op rod assembly and thus out of engagement with the sear ledge provided on the op rod assembly. At substantially the same time, the disconnector 146 disconnects from the sear 154, as shown right at the point of sear release, represented at 180 in FIG. 3.

After this disconnection, the sear 154 is able to move independently of the trigger 142, under the influence of the sear spring 156, to again extend into the path 200 of the op rod assembly and catch the sear ledge as it travels back under the influence of the expanding gases from the firing of the cartridge. The selector body 164 provides a stop for the pivoting of the sear 154 under the influence of the sear spring 156, and the sear 154 returns to its rest position. At the rest position, the sear 154 can be reengaged with the trigger 142, at the disconnector 146, when the trigger 142 is released. Then the trigger 142 can be pulled again to fire another cartridge, and so on. Thus, in the semi-automatic firing position, the selector body 164 is positioned to cause a complete disengagement of the disconnector 146 from the sear 154, permitting the sear spring 156 to return the sear 154 to a position to engage the sear ledge of the op rod assembly and thus halt firing after the firing of one cartridge.

Figure 4:
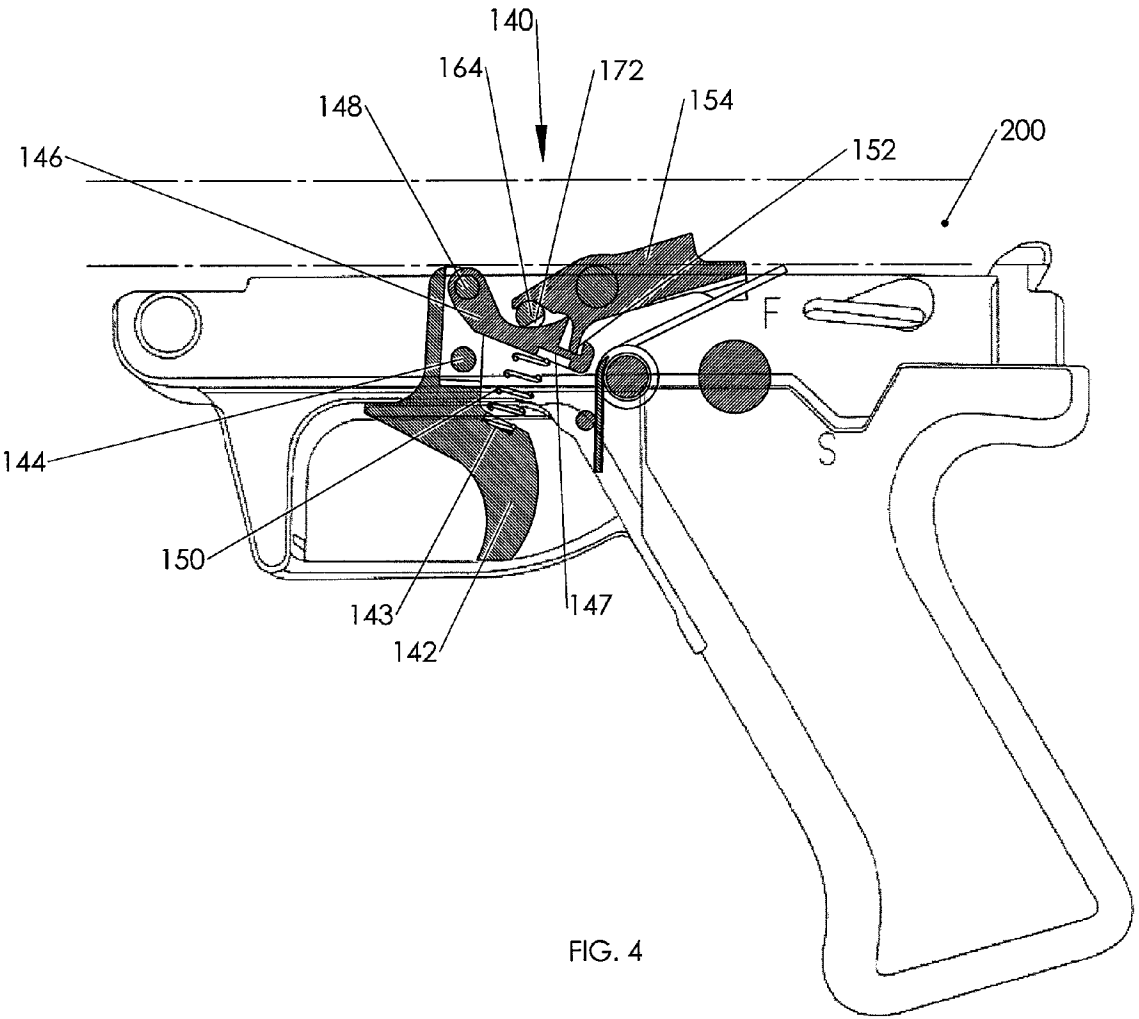
FIG. 4 is a side view, as in FIGS. 2 and 3, the components being shown in full-auto mode, with the trigger at rest.
Figure 5:
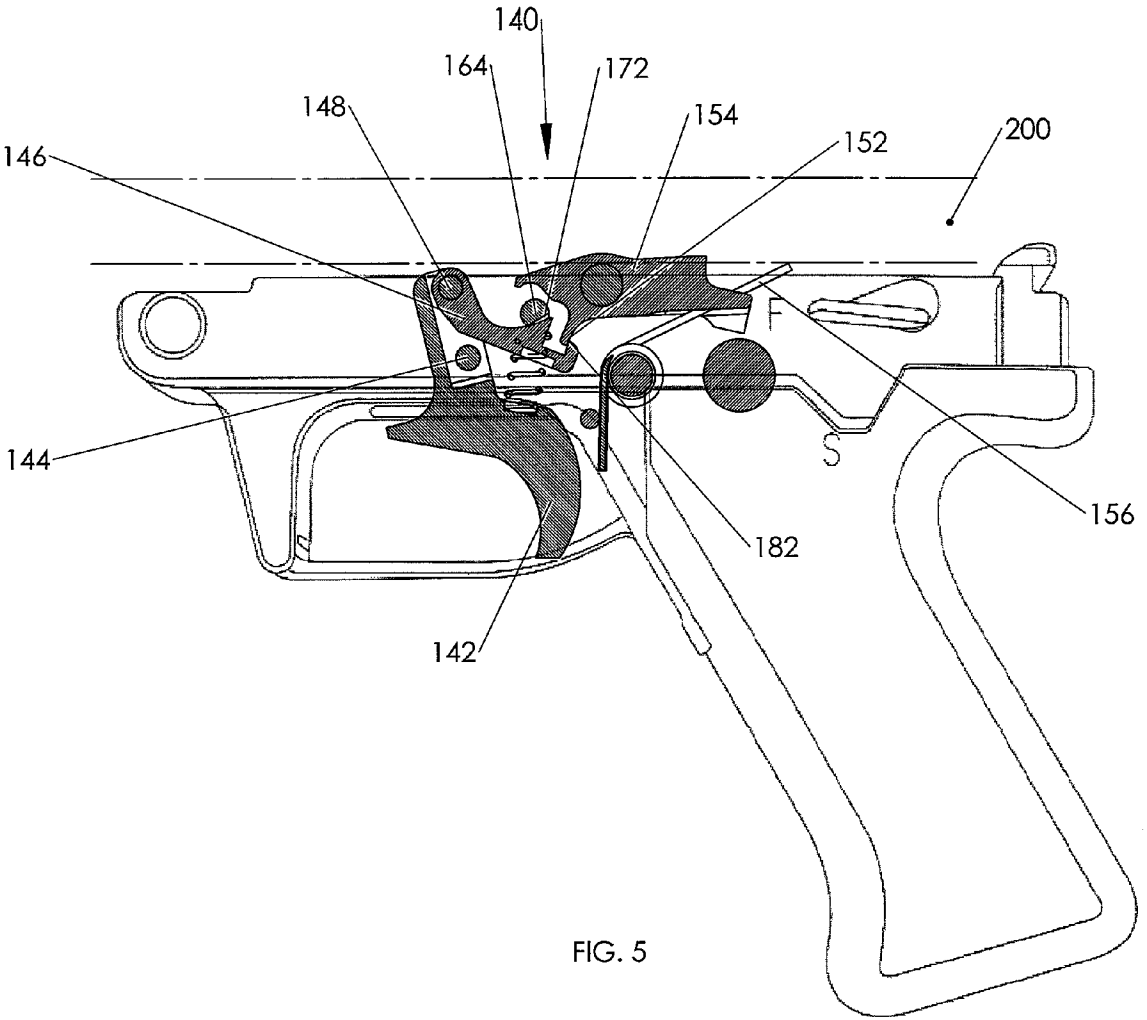
FIG. 5 is a side view, as in FIGS. 2, 3, and 4, the components being shown in full-auto mode, with the trigger pulled and the sear remaining associated with the disconnector.

In FIGS. 4 and 5, the trigger assembly 140 is shown in the fully-automatic firing position. In FIG. 4, the trigger 142 is at rest, whereas, in FIG. 5, the trigger 142 has been pulled to the point where the sear tip 158 is outside of the path 200 of the sear ledge and op rod assembly such that the sear tip 158 releases the op rod assembly for reciprocation. The select fire mechanism 160 is thus in the fully-automatic firing position. In this position, the ramped surface 166 of the disconnector 146 faces the selector body 164 with the selector body 164 positioned between the front end 168 of the sear 154 and the sloped surface. But in contradistinction to the positioning shown in the semi-automatic firing position, the selector body 164 has been rotated by movement of the lever 162 such that, when the trigger 142 is pulled, as shown, the disconnector 146 is pulled forwardly at disconnector pin 148 pulling the ramped surface 166 of the disconnector 146 against the inset contact surface 176, as opposed to the peripheral contact surface 174 of the selector body 164. Thus though the disconnector 146 is moved downwardly against the disconnector spring 150, similarly to the movement experienced in the semi-automatic firing position, the downward movement is smaller than would be achieved if the ramped surface 166 engaged the peripheral contact surface 174. This engagement (or lack of disengagement) is shown in FIG. 5 at numeral 182. As a result, the catch end 178 of the disconnector 146 will pull on the latch end 152 of the sear 154 but will not disengage from the latch end 152, as occurs in the semi-automatic firing position. The sear 154 will pivot about the sear pin 170 until the sear tip 158 is made to disconnect from the sear ledge of the op rod, thus leading to the firing of a cartridge. The sear tip 158 pivots downwardly, out of the path 200 of the op rod assembly and thus out of engagement with the sear ledge provided on the op rod assembly, and, because the disconnector 146 does not disconnect from the sear 154, the sear tip 158 will remain out of the path 200 of the sear ledge so long as the trigger 142 remains pulled, and the op rod assembly will continue to cycle and fire in a fully automatic mode. Releasing the trigger 142 will permit the sear spring 156 to return the sear 154 to the rest position where it is able to engage the sear ledge of an op rod assembly and halt the firing until the trigger 142 is pulled again.

In accordance with this invention, a fully automatic M60 Assault Rifles in which an op rod assembly reciprocates to effect fully automatic fire during such time as a sear remains outside of the path 200 of a sear ledge of the op rod assembly can be altered with the trigger assembly as taught herein to be selectively made to operate in either fully automatic or semi-automatic modes.

The invention claimed is:

1. A trigger assembly fitted to a trigger housing that is adapted to engage a receiver for an M60 Assault Rifle, the receiver carrying an op rod assembly that reciprocates within the receiver to fire the rifle, the trigger assembly comprising:

(a) a sear pivotally mounted to the trigger housing, the sear providing:
  (i) a sear tip, and
  (ii) a latch end;

(b) a sear spring biasing said sear to pivot to position said sear tip in the path of the op rod assembly when the trigger housing is engaged with the receiver and the trigger assembly is unactuated;

(c) a trigger pivotally mounted to the trigger housing;

(d) a disconnector pivotally connected to said trigger, said disconnector providing:
  (i) a ramped surface, and
  (ii) a catch end adapted to engage said latch end of said sear;

(e) a select fire mechanism including:
  (i) a switch accessible outside of the trigger housing and selectively movable between a fully automatic firing position and a semi automatic firing position,
  (ii) a selector body including a fully-automatic selector surface and a semi-automatic selector surface, said selector body positioned within the trigger housing and associated with said switch such that moving said switch between said fully automatic firing position and said semi-automatic firing position also moves said selector body between a fully automatic firing position and a semi-automatic firing position; and (f) a disconnector spring biasing said disconnector toward said sear and said selector body, wherein actuating the trigger assembly draws said ramped surface of said disconnector against said selector body and, when said switch is in said fully-automatic firing position, said ramped surface is drawn against said fully-automatic selector surface and, when said lever 162 is moved to said semi-automatic firing position, said ramped surface is drawn against said semi-automatic selector surface, and wherein, when said ramped surface is drawn against said fully-automatic selector surface, said catch end of said disconnector engages said latch end of said sear and pulls thereon so as to pivot said sear tip out of the path of the op rod assembly and remain out of said path until said trigger is released, and, when said ramped surface is drawn against said semi-automatic selector surface, said catch end of said disconnector engages said latch end of said sear and pulls thereon so as to pivot said sear tip out of the path of the op rod assembly and thereafter disengages such that said sear pivots on said sear spring to again extend into the path of the op rod assembly after a single firing of the M60 Assault Rifle.

2. The trigger assembly as in claim 1, wherein said switch is a lever connected to said selector body.

3. The trigger assembly as in claim 2, wherein said selector body is a longitudinal member that rotates about its longitudinal axis within the housing as said lever is moved, said selector body including a clearance cut, wherein said semi-automatic selector surface is a peripheral contact surface of the longitudinal member and said fully-automatic selector surface as an inset clearance cut surface in said longitudinal member.

* * * * *